United States Patent [19]

Brown et al.

[11] Patent Number: 4,697,604

[45] Date of Patent: Oct. 6, 1987

[54] EXPANSION OF TOBACCO

[75] Inventors: Ian C. Brown, Winchester; Roger W. Hedge, Lymington; David J. Molyneux, Southampton, all of England

[73] Assignee: British-American Tobacco Company Limited, London, England

[21] Appl. No.: 874,020

[22] Filed: Jun. 13, 1986

[30] Foreign Application Priority Data

Jun. 15, 1985 [GB] United Kingdom ..... 8515217

[51] Int. Cl.[4] ..... A24B 3/18

[52] U.S. Cl. ..... 131/296; 131/304; 55/320

[58] Field of Search ..... 55/320, 318; 131/296, 131/304

[56] References Cited

U.S. PATENT DOCUMENTS 4,407,306 10/1983 Hibbitts ..... 131/296

4,523,598 6/1985 Weiss et al. ..... 131/296

*Primary Examiner*—V. Millin

*Attorney, Agent, or Firm*—Kane, Dalsimer, Sullivan Kurucz, Levy, Eisele and Richard

[57] ABSTRACT

Tobacco expansion apparatus comprises a transport duct in which can be established a flow of hot gaseous medium and into an upstream end of which can be fed particulate tobacco. The downstream end of the duct opens into the casing of a tobacco/gaseous medium separator comprising a separation screen.

5 Claims, 1 Drawing Figure

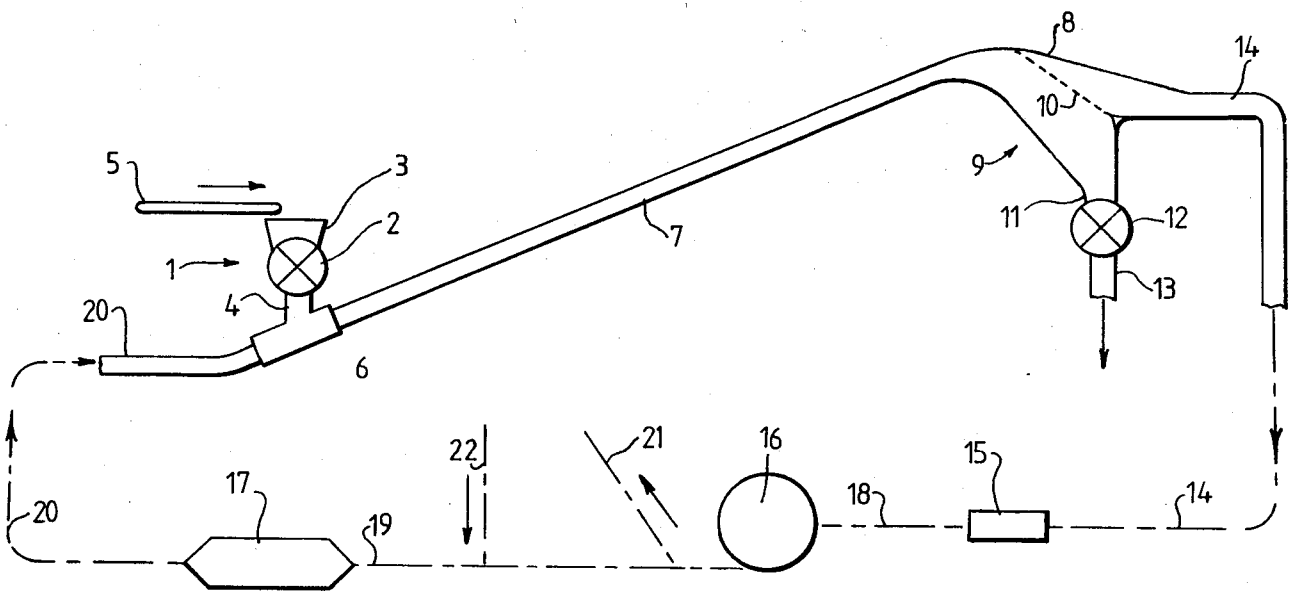
1
2
3
4
5
6
7
8
9
10
11
12
13
14
14
15
16
17
18
19
20
20
21
22

EXPANSION OF TOBACCO

BACKGROUND OF THE INVENTION

1. Field Of The Invention

This invention relates to the expansion of particulate tobacco.

2. Brief Description of the Prior Art

It is an established practice in the tobacco industry to expand and/or to dry particulate tobacco by feeding the tobacco into a transport duct in which flows a hot gaseous medium, hot air and/or steam for example, whereby the tobacco is entrained in and pneumatically transported by the medium along the duct to tobacco/-medium separation means. During the contact time of the tobacco with the hot gaseous medium in the transport duct, heat transfers from the medium to the tobacco particles, whereby there is effected a reduction of the moisture content of the tobacco particles. In some expansion processes the tobacco fed to the duct has been treated with an organic or inorganic expansion agent. In these processes the heat transferred to the tobacco from the gaseous medium serves to drive off the expansion agent, by evaporation or volatilisation from the tobacco.

Examples of pneumatic transport tobacco expansion processes are disclosed in United Kingdom Pat. Nos. 2,044,596A; 2,111,820A (U.S. Pat. No. 4,407,306); 2,122,321A; 2,155,302A; U.S. Pat. Nos. 3,386,773; 3,524,452; 3,575,178; 3,693,631; 4,044,780; 4,167,191; 4,418,706 and European Pat. Nos. 029 588 and 074 059 (U.S. Pat. 4,523,598.)

It is the teaching of EP 029 588 that if for the tobacco/medium separation means there is employed a tangential-type separator, there is accrued the advantage that the particle residence time of the tobacco in the separator is lower than that obtainable in the prior proposed cyclone-type separators. Certain it is that the longer the residence time within the separator the greater is the tendency for a proportion at least of the tobacco particles to be unduly dried. Another reason for the desirability of a low residence time in the separator is that a higher heat transfer efficiency occurs in the transport duct than in the separator, owing not only to the temperature differential between the tobacco particles and the hot gaseous medium in the duct but also to the velocity differential initially obtaining therebetween in the duct.

In U. S. Pat. No. 3,580,644 there is disclosed an automatic tobacco conveying system for pneumatically conveying tobacco from a storage area to a cigarette making machine. The system includes a separator comprising a casing, a gaseous-medium inlet to the casing, a gaseous-medium outlet from the casing which outlet is disposed generally opposite the gaseous-medium inlet, a gas pervious separation screen extending across the interior of the casing such that the gaseous-medium inlet and gaseous-medium outlet are at opposite sides of the screen, and a tobacco outlet at the same side of the screen as is the gaseous-medium inlet. A separator comprising these features is referred to hereinafter as a "separator as defined." A separator as defined is also disclosed in United Kingdom Pat. No. 1 575 175.

The present invention is based upon the realisation that an advantageous advance in the tobacco expansion art may be obtained by the use in a pneumatic transport tobacco expansion process of a separator as defined.

Summary of the Invention

The present invention provides a method of expanding tobacco, wherein a flow of hot gaseous medium is established in a transport duct, particulate tobacco treated with an expansion agent is fed into said duct, and downstream of said duct said tobacco and said medium are separated in a separator as defined.

Cut stem tobaccos, cut lamina tobaccos or blends thereof may be treated in accordance with the present invention. The gaseous medium may be, for example, steam, air, steam and air, or nitrogen.

The expansion agent may be water, an organic expansion agent or an inorganic expansion agent, an example of the last mentioned being carbon dioxide.

The temperature of the gaseous medium at the upstream end of the transport duct may be in excess of 350° C.

The present invention also provides tobacco expansion apparatus comprising gaseous medium supply means operable to supply hot gaseous medium, a transport duct, an upstream end of which duct is in gas flow communication with said supply means, tobacco feed means by which particulate tobacco can be fed to said duct, and a separator as defined, the gaseous-medium inlet of said separator being in gas flow communication with the downstream end of said duct.

BRIEF DESCRIPTION OF THE DRAWING

The accompanying drawing is a diagrammatical showing of apparatus of the invention.

DETAILED DESCRIPTION OF THE PREFERRED EMBODIMENTS OF THE INVENTION

It is a feature of a separator as defined that in the passage of gaseous medium from the gaseous-medium inlet to the gaseous-medium outlet the gaseous-medium is subjected to comparatively minor flow direction changes. This is in sharp contradistinction with the flow pattern in a cyclone or tangential separator, where the gaseous-medium is swirled along a helical flow path. The direct, non-circulatory path taken by the gaseous medium through a separator as defined is an important factor giving rise to the exceptionally low tobacco particle residence time which is a feature of the operation of a separator as defined.

In a separator as defined used for the purposes of the present invention, the separation screen suitably extends at an included angle of 135°–155° to the axis of the transport duct at the downstream end thereof. The separation screen may be of substantially flat configuration, although it could conceivably be curved over the whole or a portion(s) of its length. The screen may also be curved in the widthwise direction thereof.

Preferably the tobacco outlet of the separator communicates with airlock means.

The transport duct is preferably straight or substantially straight. It is also preferable that the transport duct should be of substantially constant cross-sectional area.

In order that the present invention may be clearly understood and readily carried into effect, reference will now be made, by way of example, to the drawing hereof, which shows diagrammatically tobacco expansion apparatus.

The tobacco expansion apparatus comprises a tobacco feeder 1 comprised of a rotary airlock 2 fitted with an inlet hopper 3 and a downwardly extending outlet pipe 4. A feed conveyor 5 is operable to feed particulate tobacco to the inlet hopper 3. At its lower end the pipe 4 opens into a short length of piping 6. At an outlet end thereof the piping 6 communicates with an upwardly inclined, straight transport duct 7, which duct may be of, for example, rectangular cross-section.

At its higher end, the duct 7 opens into a casing 8 of a separator 9. The separator 9, which is a separator as defined, is of a construction similar to that illustrated and described in United Kingdom Pat. No. 1 575 175. Extending across the interior of the casing 8, so as to divide the interior into two sections, is a gas pervious, separation screen 10 of mesh construction. A short outlet pipe 11 extends downwardly from a lowermost location of the separator 9. The pipe 11 serves to intercommunicate that section of the interior of the casing 8 which is to the side of the screen 10 at which the duct 7 opens into the casing, with a rotary airlock 12. From the airlock 12 there downwardly extends a tobacco discharge pipe 13. From the separator 9 there also extends a pipe 14 serving to intercommunicate the section of the interior of casing 8 which is to the side of the screen 10 remote the pipes 7 and 11, with the inlet of a centrifugal fan 15.

The tobacco expansion apparatus further comprises a cyclone dust extractor 16 and a heater 17 which, together with interconnecting pipes 18–20, provide a recirculatory loop communicating with the upstream end of the piping 6. Reference numerals 21 and 22 designate an exhaust pipe and a steam make-up pipe respectively.

In operation of the apparatus to expand particulate tobacco, cut stem tobacco for example, circulation of a steam/air mixture is established under action of the fan 15.

The tobacco is fed to the hopper 3 from the conveyor 5 and passes through the rotary airlock 2, driven by rotary drive means (not shown) and the pipe 4 to the piping 6. In the piping 6 the tobacco particles are entrained by the hot steam/air mixture. It is preferable, in order to promote the entrainment of the tobacco particles, for the interior of the piping 6 to be of venturi configuration with the pipe 4 opening at the venturi throat.

The steam/air mixture transports the tobacco particles along the duct 7 to the separator 9, the mesh screen 10 of which permits passage therethrough of the steam/air mixture to the pipe 14 but constrains the tobacco particles to pass downwardly to the airlock 12, driven by rotary drive means (not shown). The tobacco particles pass from the airlock 12 through the discharge pipe 13 to a receptacle or conveyor (not shown). The tobacco particles are subsequently subjected to a cooling step which is in accordance with established practice and which, for the sake of brevity, is not further discussed.

The steam/air mixture flows through the pipe 14 from the separator 9 to the fan 15 and thence to the dust extractor 16. Gases and water vapour generated in the apparatus and air which has entered the apparatus through the airlocks 2 and 12 are removed via exhaust pipe 21. Make-up steam can be supplied, from a steam generator (not shown), via the make-up pipe 22. Heat given up by the steam/air mixture during the passage thereof through the apparatus may be replaced by operation of the heater 17, which may, for example, be gas or oil-fired. Because the mean residence time of the tobacco particles in the separator 9 is so short, the overall mean residence time in the apparatus is short. It may, for example, be less than one second. For this reason it is possible to employ a higher temperature gaseous medium without the tobacco particles being subject to an over intensive heating regime.

What is claimed is:

1. A method of expanding tobacco, which comprises;

establishing a flow of hot gaseous medium in a transport duct;

feeding particulate tobacco treated with an expansion agent into said duct; and separating said tobacco from said medium in a separator downstream of the duct; whereby the exposure time of said tobacco to said medium is less than one second; said separator comprising a casing, a gaseous-medium tobacco inlet to the casing, a gaseous-medium outlet from the casing which outlet is disposed generally opposite the gaseous-medium inlet, a gas pervious separation screen extending across the interior of the casing such that the gaseous-medium inlet and gaseous-medium outlet are at opposite sides of the screen, and a tobacco outlet at the same side of the screen as is the gaseous-medium inlet.

2. A method according to claim 1, wherein the temperature of said gaseous medium at entry to said transport duct is at least 350° C.

3. Tobacco expansion apparatus comprising gaseous medium supply means operable to supply hot gaseous medium, a transport duct, an upstream end of which duct is in gas flow communication with said supply means, tobacco feed means by which particulate tobacco can be fed to said duct, and a separator, which comprises; a casing, a gaseous-medium tobacco inlet to the casing, a gaseous-medium outlet from the casing which outlet is disposed generally opposite the gaseous-medium inlet, a gas pervious separation screen extending across the interior of the casing such that the gaseous-medium inlet and gaseous-medium outlet are at opposite sides of the screen, and a tobacco outlet at the same side of the screen as is the gaseous-medium inlet; the gaseous-medium tobacco inlet of said separator being in gas flow communication with the downstream end of said duct.

4. Apparatus according to claim 3, wherein the tobacco outlet of said separator communicates with airlock means.

5. Apparatus according to claim 3, wherein the separation screen of said separator extends at an included angle of 135° to 155° to the axis of the transport duct at the downsteam end thereof.

* * * * *